United States Patent [19]

Leibow

[11] Patent Number: 4,528,712

[45] Date of Patent: Jul. 16, 1985

[54] PAINTING APPARATUS

[76] Inventor: Saul Leibow, 5700 Collins Ave., Miami Beach, Fla. 33140

[21] Appl. No.: 579,976

[22] Filed: Feb. 13, 1984

[51] Int. Cl.[3] ..... B05C 17/00; B05C 17/02

[52] U.S. Cl. ..... 15/118; 15/210 R; 15/230.11; 15/246

[58] Field of Search ..... 15/210 R, 230.11, 246, 15/257 R, 118; 29/110.5, 120

[56] References Cited

U.S. PATENT DOCUMENTS

| | | | |
|---|---|---|---|
| 2,735,128 | 2/1956 | Adams | 15/230.11 |
| 3,369,269 | 2/1968 | Deck et al. | 15/230.11 |
| 3,790,984 | 2/1974 | Spransy et al. | 15/248 A |

FOREIGN PATENT DOCUMENTS

| | | | |
|---|---|---|---|
| 1377971 | 12/1974 | United Kingdom | 15/230.11 |

*Primary Examiner*—Edward L. Roberts

*Attorney, Agent, or Firm*—Wolf, Greenfield & Sacks

[57] ABSTRACT

A painting apparatus including a handle having supported therefrom, a paint roller and means for commonly supporting with the paint roller, a paint pad, whereby both the roller and pad can be operated and maneuvered from the paint apparatus handle. In one embodiment, the paint pad is fixed in position relative to the roller while in other embodiments described herein, the paint pad is movable relative to the roller; and one embodiment actually picking paint up from the roller.

5 Claims, 12 Drawing Figures

Fig. 1
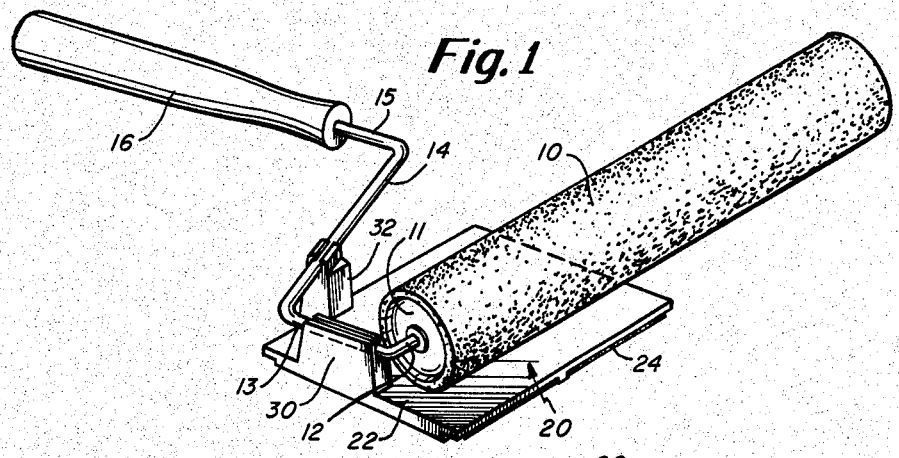
Fig. 2
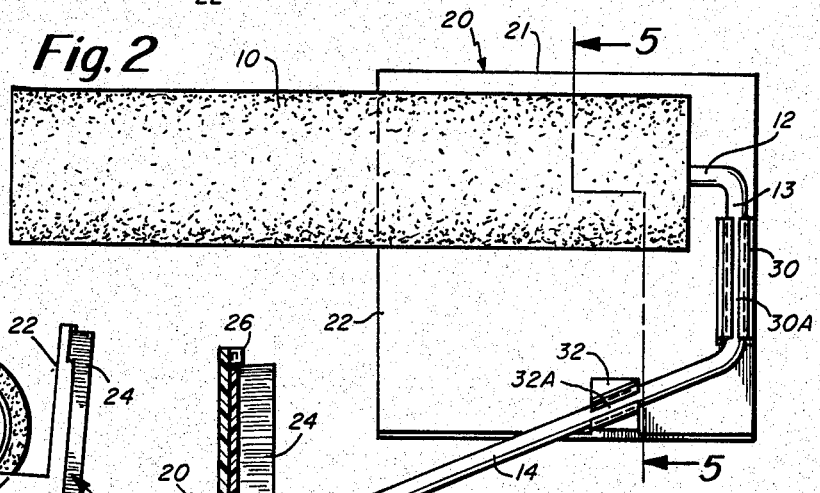
Fig. 3
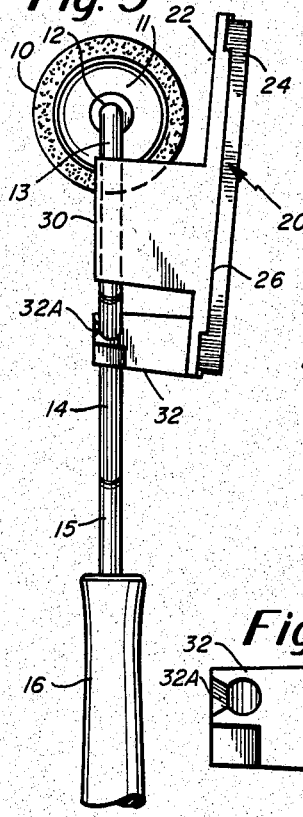
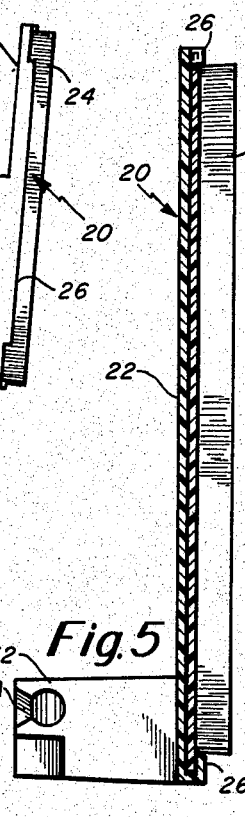
Fig. 5
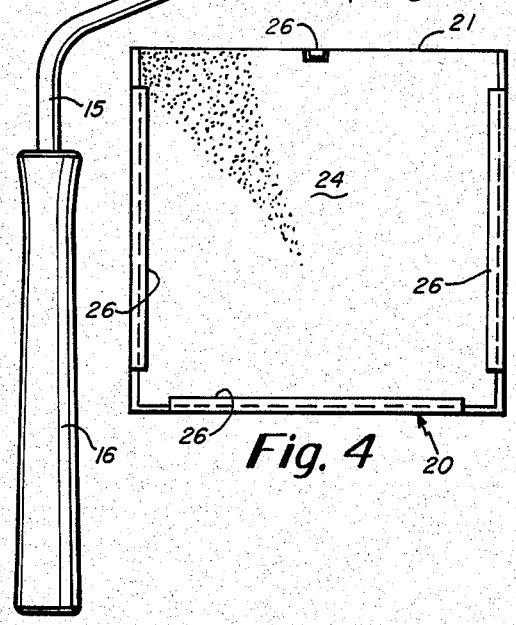
Fig. 4

50
40
41
42
43
44
45
46
47
48
52
54
55
56
58
62

PAINTING APPARATUS

BACKGROUND OF THE INVENTION

The present invention relates in general to an apparatus for applying paint to a wall, ceiling, or other like structure. More particularly, the present invention relates to a painting apparatus that is adapted to conveniently unite a paint roller with a paint pad.

At the present time, a paint roller is extensively used, particularly for applying paint to walls or a ceiling in a room. Although the paint roller can be used to cover the majority of the surface, a paint brush or more usually, a painting pad is used in a separate step for finishing at any edges, such as the edges between the wall and ceiling or between separate walls. It is thus necessary to have a separate roller and a separate paint pad, each of which is used in separate steps in carrying out the painting of the room.

Accordingly, it is an object of the present invention to provide an improved painting apparatus which incorporates the paint roller and paint pad into a single unitary painting apparatus.

Another object of the present invention is to provide an improved painting apparatus employing a paint roller and paint pad and in which the painting steps can be carried out more quickly and effectively.

A further object of the present invention is to provide an improved painting apparatus incorporating a unitary paint roller and paint pad structure which is of relatively simple construction and which can be used very effectively, even by a relatively unskilled painter.

SUMMARY OF THE INVENTION

To accomplish the foregoing and other objects, features and advantages of the invention, there is provided a painting apparatus which comprises a roller, means for supporting the roller to permit free rotation thereof, and a paint pad. The paint roller is of cylindrical construction while the paint pad is preferably a flat pad. In accordance with the invention, means are provided for supporting the paint pad in a unitary manner adjacent to the paint roller but with the paint roller being freely usable without interference from the paint pad and likewise the paint pad being freely usable without interference from the paint roller. In one embodiment of the present invention, the paint roller and its support includes a handle and the paint pad is supported from the support structure for the roller. In an alternate embodiment of the invention, the support pad is mounted for both sliding and pivotal action relative to the paint roller support. In this way the paint pad may be moved from a rest position to a use position. It is rotatable to face in an opposite non-interfering position relative to the roller. In still a further embodiment of the present invention, the paint pad is non-rotatable but is slidable between a rest position and a use position.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is a perspective view of a first embodiment of the present invention in which the paint pad is in a fixed position relative to the paint roller;

FIG. 2 is a plan view of the apparatus of FIG. 1;

FIG. 3 is a side elevation view of the painting apparatus of FIGS. 1 and 2;

FIG. 4 is a plan view of the painting pad;

FIG. 5 is a cross-sectional view through the painting pad as taken along line 5—5 of FIG. 2;

DETAILED DESCRIPTION

Figures 6, 7, 8:
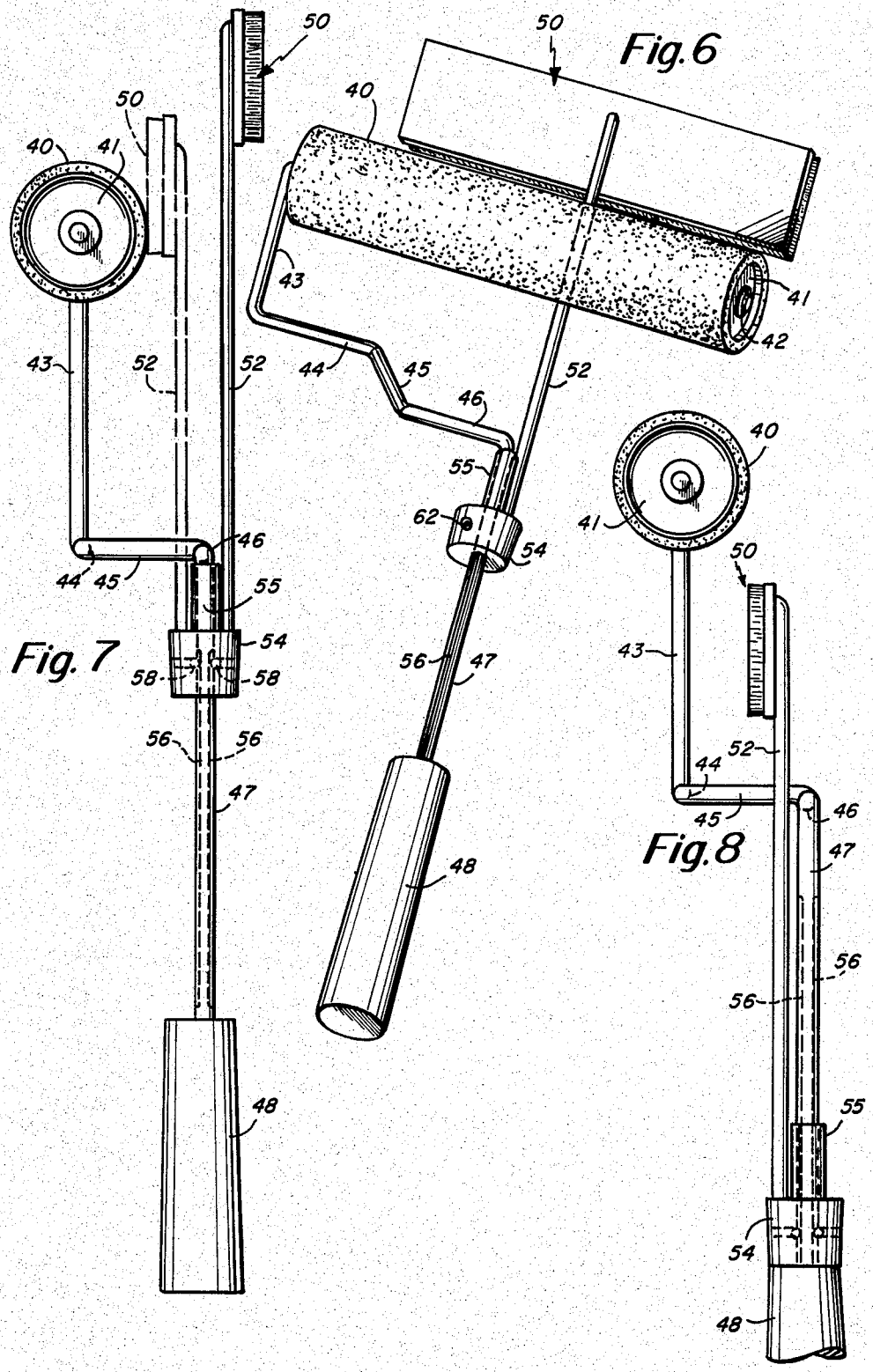
FIG. 6 is a perspective view of an alternate embodiment of the invention in which the paint pad is movable between a rest position and a use position.
FIG. 7 is a side elevation view of the embodiment of FIG. 6 showing a paint pad in phantom picking up paint from the roller and also showing the paint pad in solid in its final use position.
FIG. 8 is a fragmentary side elevation view showing the paint pad in its rest position, out of use and not interfering with the paint roller.
Figures 9, 10, 11, 12:
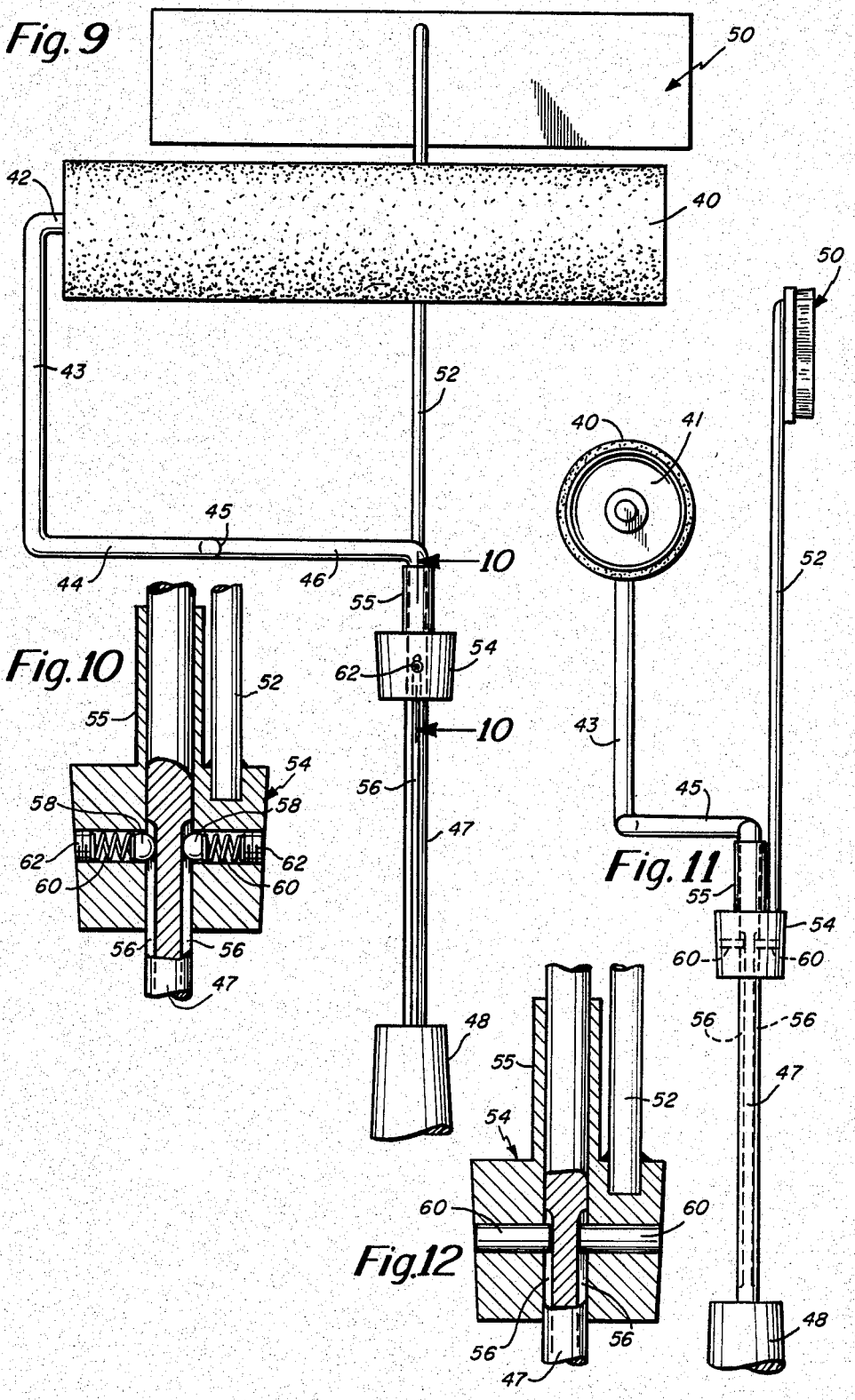
FIG. 9 is a plan view showing the paint pad in its use position such as illustrated in FIGS. 6 and 7.
FIG. 10 is a cross-sectional view taken along line 10—10 of FIG. 9 showing the details of the ball detent arrangement for enabling rotation of the paint pad.
FIG. 11 is a side elevation view of a further alternate embodiment in which the paint pad is slidable between a use and rest position, but is non-rotatable.
FIG. 12 is a cross-sectional view of this alternate embodiment showing details of the means for permitting sliding but preventing rotation of the paint pad support.

A first embodiment of the present invention is illustrated in FIGS. 1–5. In this embodiment, the paint pad is in a fixed position relative to the paint roller but is mounted in a manner so that the paint pad can be used without interfering with the paint roller and vice versa. A second embodiment of the present invention is illustrated in FIGS. 6–10. In this embodiment of the invention, the paint pad has multiple positions including a rest position as illustrated in FIG. 8, a position in which paint may be picked up from the roller as shown in phantom in FIG. 7 and a final use position such as illustrated in solid in FIG. 7 and also illustrated in FIGS. 6 and 9. The last embodiment of the present invention is illustrated in FIGS. 11 and 12. In this embodiment of the invention, the paint pad and its associated support is slidable in a linear direction, such as up and down in FIG. 11 but is non-rotatable. The paint, instead of being picked up from the roller, is applied to the pad by simply dunking the pad into the roller tray or into a paint bucket.

In FIGS. 1–5, there is shown a paint roller 10 which is supported at its ends in a conventional manner, such as by the use of roller support disks 11 which engage with a support rod extending the length of the roller 10. This support rod 12 is illustrated in FIG. 2 and forms the means for support of the roller. The rod 12 also includes segments 13, 14, and 15. The handle 16 is attached to the rod segment 15.

This first embodiment also illustrates the paint pad 20 which is comprised of a base member 22 which is adapted to support a paint retaining pad 24. FIG. 5 illustrates a cross-sectional view through the paint pad means 20. FIG. 5 illustrates the manner in which the paint retaining pad 24 is interlocked by means of tabs 26 as also illustrated in FIG. 4. The paint retaining pad 24 may easily be removed from the base 22 for replacement thereof or for possible cleaning.

FIGS. 1–5 also illustrate the manner in which the paint pad means 20 is supported from the paint roller structure. In this regard, there is provided two integral support members including members 30 and 32. Each of these members has a respective top slot 30A and 32A. And the pad is thus easily snap-fitted with the support rod segments by the application of force. For example, FIGS. 1 and 2 illustrate the segment 13 of the support being snap-fitted into the slot 30A while at the same time the segment 14 of the support is snap-fitted into the slot 32A associated with support member 32. It is noted that the slots 30A and 32A extend in the same direction as the angle provided between the segments 13 and 14. This thus positions the pad in the position illustrated in FIG. 2. It is also noted that the paint retaining pad 24 faces in a direction opposite to the roller 10.

With the apparatus illustrated in FIGS. 1–5, it can be readily seen that with a single unitary structure, both pad use and roller use can take place without swamping between the two different devices. The both devices, namely, the pad and roller, are supported from the same structure and thus the device is an extreme time saving device. The roller 10 is used in the normal manner, such as in conjunction with a roller pan for applying paint to the roller. When it is desired to do edging, then the pad is used. The pad can be simply dipped into the roller pan for applying paint to the paint retaining pad 24. It is also noted in the embodiment of FIGS. 1–5, that the operation of the roller does not interfere with that of the pad and vice versa. When the roller is in use, the pad is on the opposite side. It thus does not contact any surface that the roller is contacting. Similarly, when the pad is in use, the roller is on the opposite outer side remote from the wall and thus the roller does not interfere with pad usage. In this regard, it is also noted, that in the use position, such as illustrated in FIG. 2, the top of the pad at edge 21 extends beyond the roller so that at an edge, such as between the ceiling and a wall, the roller does not interfere with pad operation.

FIGS. 6–10 illustrate a second embodiment of the present invention. This embodiment of the invention differs from the first embodiment, primarily with respect to the fact that the roller itself is used to apply paint to the pad. In the second embodiment, the pad is movable from a rest position to a position in which the pad contacts the roller for picking up paint such as shown in phantom in FIG. 7 to a rotated position such as shown in solid in FIG. 7 in which the pad is ready for use.

In the embodiments of FIGS. 6–10, there is shown a roller 40 which is supported in a substantially conventional manner such as with the use of end support disks 41. These disks along with a linear support rod, support the roller 40. The support also includes besides the straight segment 42 that extends through the roller 40, segments 43, 44, 45, 46, and 47. The handle 48 is attached to the support segment 47. It is noted in this second embodiment, that the support rod is bent in a manner including segment 45 so that the roller, such as illustrated in FIGS. 7 and 8, is offset from the handle and associated support rod segment 47. This offset arrangement enables the pad to slide to pick up paint as illustrated in FIG. 7.

Thus, in this second embodiment, there is also shown a paint pad 50 which may be of similar construction to the pad illustrated in the first embodiment. However, it is noted that the pad 50, such as illustrated in FIG. 6, has a rectangular shape rather than a square shape and thus more closely matches the configuration of the roller. The pad 50 preferably includes a base and a pad construction that retains paint. The paint pad 50 is supported by means of support rod member 52, which is affixed at one end to the pad 50, and is fixedly supported at its lower end in the slide member 54.

The details of the slide member are illustrated in FIG. 10. In this connection, it is noted that the support rod segment 47 has oppositely disposed keyways 56 which are adapted to receive respective balls 58 and associated respective springs 60. (See FIG. 10). A retaining set screw 62 may be used for holding the ball and spring arrangement in place. This ball detent enables sliding of the slide member 54, up and down the segment 47 and also allows rotation of the slide member 54 between two 180° opposite positions, each of which is a detented position. Detent is provided by interaction of each of the balls with the oppositely disposed keyways.

Now, FIG. 8 illustrates the slide member 54 in its lowermost position with the paint pad 50 disposed also at its lowermost position and below the roller 40. When it is desired to use the paint pad, then the slide member 54 is moved upwardly to the position illustrated in FIG. 7. FIG. 7 also illustrates in phantom, the pad 50 passing in contact with the roller 40 so as to pick paint up from the roller and essentially transfer it to the pad. When the slide member 54 reaches its very uppermost position, then the slide member 54 is rotatable through 180° to the position shown in solid in FIG. 6. It is noted that in this position, the paint pad has now picked up paint from the roller and is ready for use. It is also noted that the paint pad 50 is disposed in an opposite direction to the roller 40 so that there is no interference between the pad and the roller.

During use of the pad, if it is desired to reapply paint to the pad, then the slide member 54 is simply rotated back through 180° and the slide member 54 is moved downwardly and then back up again. The slide member 54 is then rotation back through 180° to the position shown in solid in FIG. 7 and the pad is ready for subsequent use. This reapplication of paint to the pad is assumed to occur with the roller 40 having sufficient paint therein to enable transfer of sufficient paint to the pad for use as indicated previously in doing edges, such as between the wall and ceiling in a room. Again, when the pad is not to be used, then the pad can be moved to the position of FIG. 8.

In the position of FIG. 7 in which the pad is in its use position, it may be interlocked in that use position by any one of a number of means. For example, the collar 55 attached to the top of the slide member 54 may provide a tight fit with the segment 47. Alternatively, there might be a double detent arrangement in which the balls 58 also fall into a further channel in the member 47 for retaining the slide member 54 in its uppermost position as illustrated in FIG. 7.

FIGS. 11 and 12 illustrate a third embodiment of the present invention which is quite similar to the second embodiment, but which somewhat simplifies the second embodiment of the invention. As mentioned previously in the second embodiment of the present invention, the slide member 54 not only slides, but is also capable of rotation with their being detented positions 180° apart, so that the pad can be rotated such as illustrated by the two positions in FIG. 7. However, in FIGS. 11 and 12 which represent the third embodiment, the slide member 54 only slides. In this third embodiment, like reference characters are used to identify like parts previously identified in the second embodiment.

Thus, in this third embodiment, there is provided a roller 40 supported by means of a support rod construction including a handle 48 and support segments 43–47. FIG. 11 illustrates the straight section 47 to which the handle 48 is attached and the associate keyways 56, one on either side of the support rod segment 47. FIG. 12 illustrates the oppositely disposed relationship of these keyways 56. In this embodiment, in order to prevent rotation, instead of providing a ball and spring arrangement, there are provided oppositely disposed pins 60 which are fixed in the slide member 54 and have their ends extend into the keyways 56. These pins enable sliding movement of the slide member 54 up and down as in FIG. 11 but the pins prevent rotation of the slide member 54. These pins are interlocked with the slide member 54 in the position shown in FIG. 11 with the pad 50 directed oppositely to the roller 40. In FIG. 11 the pad 50 is shown in its use position. Paint is applied in this third embodiment, not by virtue of contact of the pad with the roller, because this is prevented in the third embodiment, but instead by virtue of simply dipping the paint pad into the roller tray. The pad and its support provided by slide member 54 may also be moved to a lower position, such as the position illustrated in FIG. 8 in which case the pad 50 is lowermost position completely out of the way of the roller 40. As with the second embodiment, the slide member 54 may be temporarily held in its uppermost position by a force-fit between the collar 55 and the rod 47 or by other means such as by an additional detent arrangement.

Having described one embodiment of the present invention, it should now be apparent to those skilled in the art that numerous other embodiments are contemplated as falling within the scope of this invention.

What is claimed is:

1. Painting apparatus comprising; a paint retaining roller, support means for the roller including a handle, a paint retaining pad and means supporting said paint retaining pad from said roller support means including means for holding said pad in a use position with the pad directed oppositely to the roller, in said use position, said roller disposed out of interference with the pad and said pad disposed out of interference with the roller, said means for supporting the pad comprising a slide member and means associated with the roller support means for accommodating the slide member, said means for accommodating the slide member including means permitting rotation thereof so that the slide member and the pad supported therefrom can assume opposite positions, in one position enabling sliding of the slide member so that the paint pad may pick up paint from the paint roller, and in a second position, rotating the paint pad so that the paint pad is directed away from the paint roller.

2. Painting apparatus as set forth in claim 1 wherein said pad comprises a base and a removable paint retaining pad.

3. Painting apparatus as set forth in claim 1 wherein the support means for the roller includes offset support so that the roller is linearly offset from the handle.

4. Painting apparatus comprising; a paint retaining roller, support means for the roller including a handle, a paint retaining pad and means supporting said paint retaining pad from said roller support means including means for holding said pad in a use position with the pad directed oppositely to the roller, in said use position, said roller disposed out of interference with the pad and said pad disposed out of interference with the roller, said means for supporting the pad comprising a slide member, said support means for the roller including a straight support segment with the slide member adapted to slide up and down the straight support segment, means for providing relative support between the slide member and roller support means for enabling rotation of the slide member, a ball detent means for providing opposite detent positions of the slide member, in one position enabling sliding of the slide member so that the paint pad may pick up paint from the paint roller and in a second position directing the paint pad away from the paint roller.

5. Painting apparatus as set forth in claim 4 wherein the support means for the roller includes offset support so that the roller is linearly offset from the handle.

* * * * *